US005589627A

United States Patent [19]

Sutton

[11] Patent Number: 5,589,627

[45] Date of Patent: Dec. 31, 1996

[54] SENSOR FAULT DETECTION

[75] Inventor: David M. Sutton, Camberley, Great Britain

[73] Assignee: British Gas plc, London, Great Britain

[21] Appl. No.: 381,562

[22] Filed: Jan. 31, 1995

[30] Foreign Application Priority Data

Feb. 2, 1994 [GB] United Kingdom ..... 9402018

[51] Int. Cl.[6] ..... F23N 5/00

[52] U.S. Cl. ..... 73/1 G; 431/76

[58] Field of Search ..... 73/1 G; 60/276, 60/277; 432/37; 431/76

[56] References Cited

U.S. PATENT DOCUMENTS

| | | | |
|---|---|---|---|
| 4,492,559 | 1/1985 | Pocock | 431/76 |
| 4,676,213 | 6/1987 | Itsuji et al. . | |
| 5,037,291 | 8/1991 | Clark . | |

FOREIGN PATENT DOCUMENTS

| | | |
|---|---|---|
| 0402953 | 12/1990 | European Pat. Off. . |
| 0549566 | 6/1993 | European Pat. Off. . |
| 1588667 | 4/1981 | United Kingdom . |
| 2181253 | 4/1987 | United Kingdom . |
| 2194846 | 3/1988 | United Kingdom . |
| 2204428 | 11/1988 | United Kingdom . |

*Primary Examiner*—Robert Raevis

*Attorney, Agent, or Firm*—Oblon, Spivak, McClelland, Maier & Neustadt, P.C.

[57] ABSTRACT

Apparatus is provided for detecting faults in a sensor providing an output voltage representative of aeration of a combustible mixture. The apparatus comprises a control box which checks whether the value of a reference voltage with which the output voltage is compared to control the aeration is suitable for causing an intended value of the aeration to be maintained.

7 Claims, 4 Drawing Sheets

Figure 1:
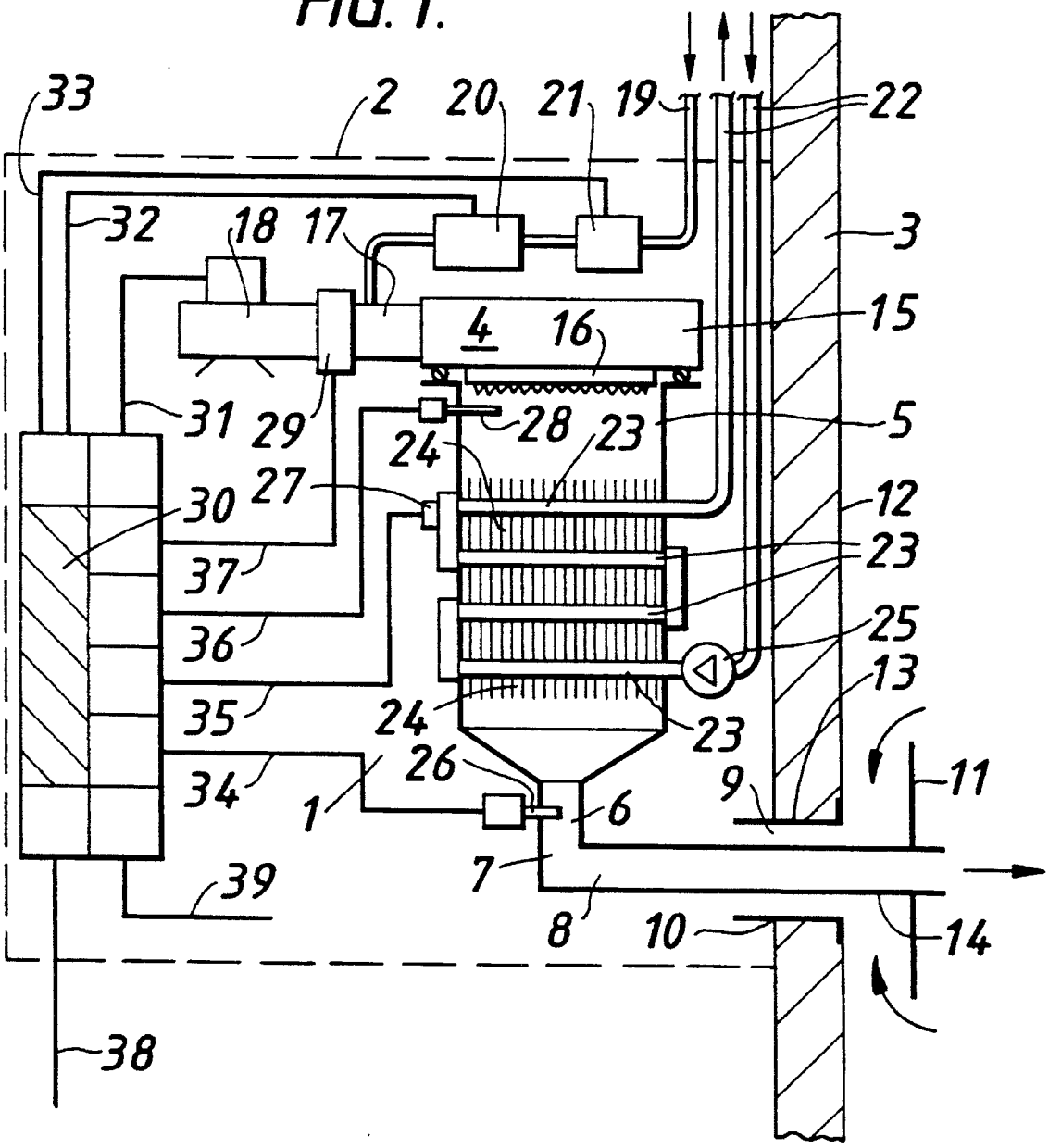

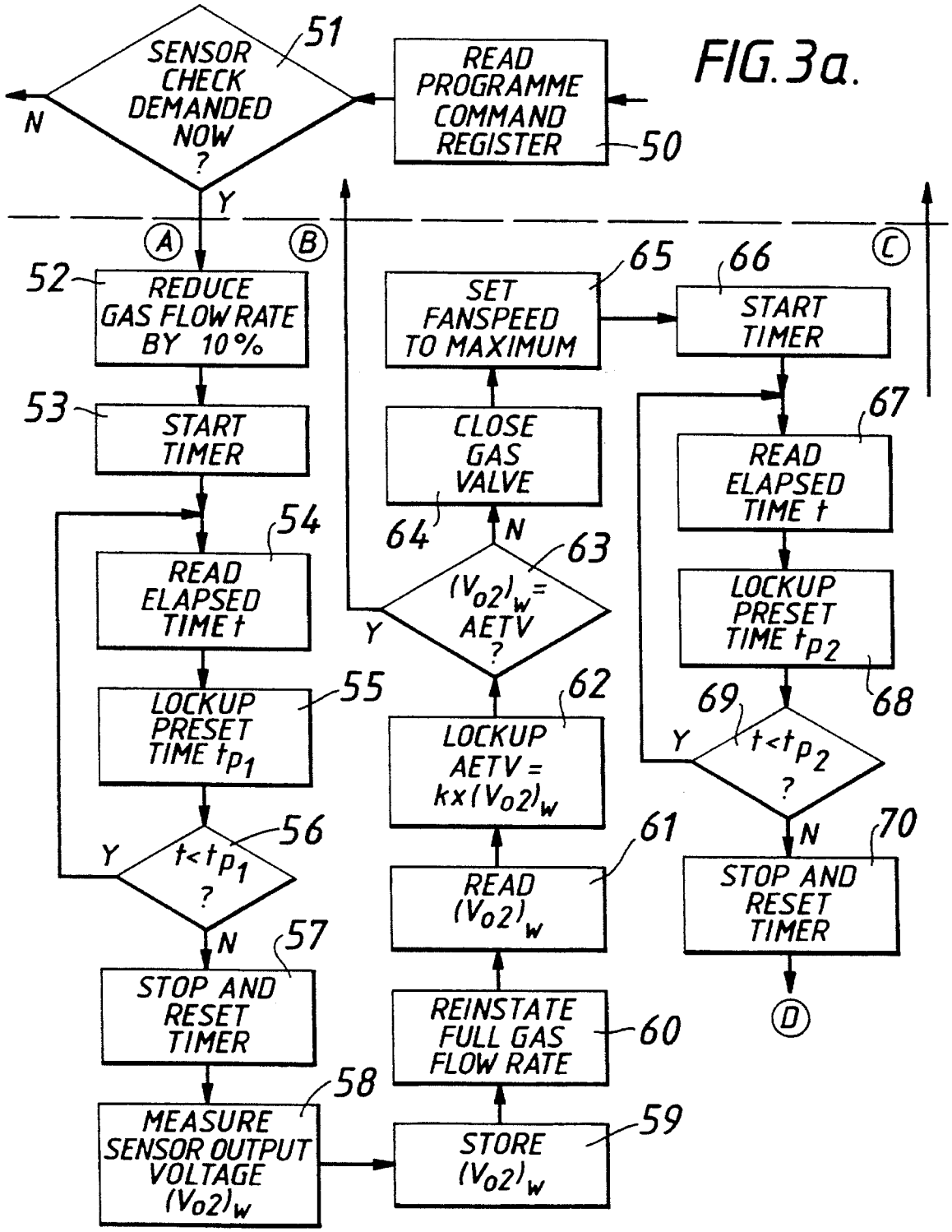
FIG. 3a.
SENSOR CHECK DEMANDED NOW ?
51
N
Y
READ PROGRAMME COMMAND REGISTER
50
A
B
C
52
REDUCE GAS FLOW RATE BY 10%
53
START TIMER
54
READ ELAPSED TIME t
55
LOCKUP PRESET TIME $t_{P1}$
56
$t<t_{P1}$ ?
Y
N
57
STOP AND RESET TIMER
58
MEASURE SENSOR OUTPUT VOLTAGE $(V_{O2})_W$
59
STORE $(V_{O2})_W$
60
REINSTATE FULL GAS FLOW RATE
61
READ $(V_{O2})_W$
62
LOCKUP AETV = $k \times (V_{O2})_W$
63
$(V_{O2})_W$ = AETV ?
Y
N
64
CLOSE GAS VALVE
65
SET FANSPEED TO MAXIMUM
66
START TIMER
67
READ ELAPSED TIME t
68
LOCKUP PRESET TIME $t_{P2}$
69
$t<t_{P2}$ ?
Y
N
70
STOP AND RESET TIMER
D

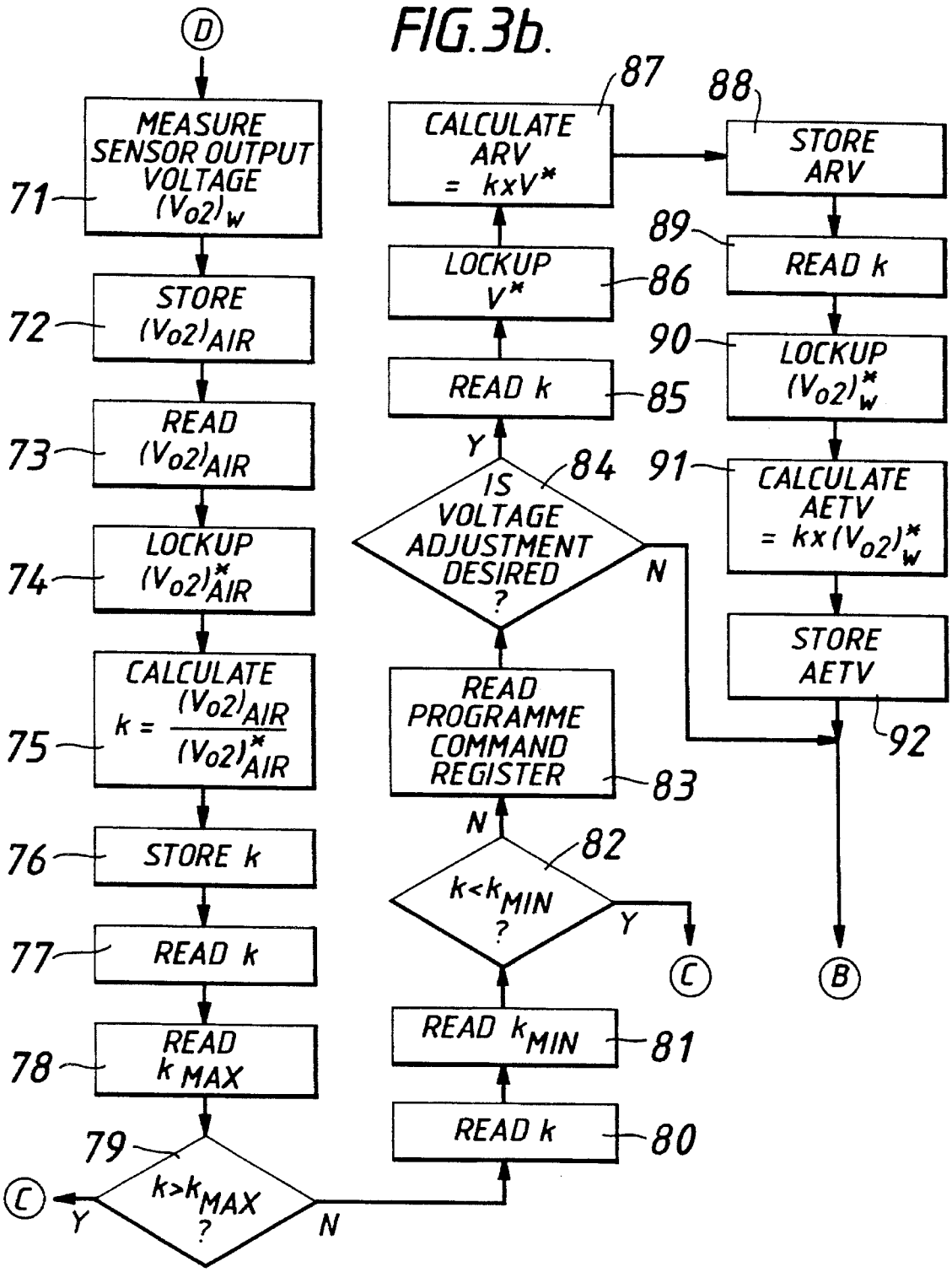
FIG. 3b.
D
MEASURE SENSOR OUTPUT VOLTAGE $(V_{O2})_W$
71
STORE $(V_{O2})_{AIR}$
72
READ $(V_{O2})_{AIR}$
73
LOCKUP $(V_{O2})^*_{AIR}$
74
CALCULATE $k = \frac{(V_{O2})_{AIR}}{(V_{O2})^*_{AIR}}$
75
STORE k
76
READ k
77
READ $k_{MAX}$
78
79
$k > k_{MAX}$ ?
Y
N
C
READ k
80
READ $k_{MIN}$
81
82
$k < k_{MIN}$ ?
Y
N
C
READ PROGRAMME COMMAND REGISTER
83
IS VOLTAGE ADJUSTMENT DESIRED ?
84
Y
N
READ k
85
LOCKUP $V^*$
86
CALCULATE ARV = $k \times V^*$
87
STORE ARV
88
READ k
89
LOCKUP $(V_{O2})^*_W$
90
CALCULATE AETV = $k \times (V_{O2})^*_W$
91
STORE AETV
92
B

SENSOR FAULT DETECTION

The present invention relates to an apparatus for detecting faults in a combustion sensor.

The invention is principally concerned with combustion systems of the so called fully premixed type in which air, usually delivered under pressure by a powered fan, is mixed in a chamber with a fuel e.g. gas delivered under pressure from a main via a control valve before the mixture is ignited on a burner.

In order to ensure that combustion occurs safely but efficiently it is the practice to seek to ensure as far as possible that the ratio of the flow rate in unit time of air to the flow rate in unit time of fuel gas (the so called air to gas ratio) is maintained at a ratio somewhat above the stoichiometric value at which, in theory, there is just sufficient air to ensure all the gas is burnt. This practice reduces the likelihood of the ratio going sub-stoichiometric by accident, and giving rise to toxic constituents in the exhaust stream. Typically the intended ratio is 1.3 times the stoichiometric air to gas ratio, expressed alternatively as "130% aeration".

In fully premixed burner systems of the type described, if the burner can be operated over a range of power outputs, the aeration may be maintained at its intended level (say 130%) by controlling the gas flow rate and air flow rate so that they remain always in the correct relative proportion. To achieve this, most modern combustion systems are provided with a control system which includes a combustion sensor, this being often located in the exhaust ducting. One type of sensor senses the oxygen content of the combustion products after the gas has been burnt. It is important that there should be no dilution introduced into the product stream between the burner and the site of the sensor.

In use, the sensor provides an output signal in the form of a voltage which is related to the oxygen concentration in the combustion products, which in turn is directly related to the aeration of the air/gas mixture. The magnitude of the output voltage is compared with the magnitude of a reference signal also in the form of a voltage previously stored in say, a computer. The reference voltage is directly related to the intended aeration. If the magnitude of the sensor output voltage corresponds to that of the reference voltage no action is taken. However, if the sensor output voltage falls below, or alternatively exceeds, the reference voltage an error signal voltage is generated which respectively either speeds the fan up to increase aeration, or slows it down to reduce aeration, until the sensor output voltage and reference voltage correspond.

The type of combustion control system described above is well known in industrial heavy duty applications. However, it is little used in domestic equipment (including hot water and central heating appliances) because it is relatively expensive. In particular, the cost of a reliable sensor is a major element of the overall cost of a domestic combustion control system. Cheaper sensors, however, may generate inaccurate output signals in the course of time due to their seals becoming faulty and allowing air to penetrate the sensor. This results in the output signal being higher than it should be for any given aeration causing the fan speed to be reduced to reduce the perceived over-aeration. During combustion, the aeration may therefore fall close to, or into, the sub-stoichiometric range, and this is unacceptable on grounds of safety.

It is therefore a principal object of the present invention to provide means whereby faults arising in combustion sensors may be detected.

It is a subsidiary object to provide means whereby detected faults in the combustion sensor may be compensated for so as to enable the air/gas ratio (aeration) to be maintained at an intended value.

It is a further subsidiary object of the present invention to provide means whereby the combustion system is shut down only if a detected fault should exceed a selected degree of severity, the system otherwise continuing in operation.

According to the present invention, we provide apparatus for detecting faults in a sensor providing an output signal representative of aeration of a combustible mixture, the apparatus comprising means for checking whether the value of a reference signal with which the output signal is compared to control the aeration is suitable for causing an intended value of the aeration to be maintained.

Figure 2:
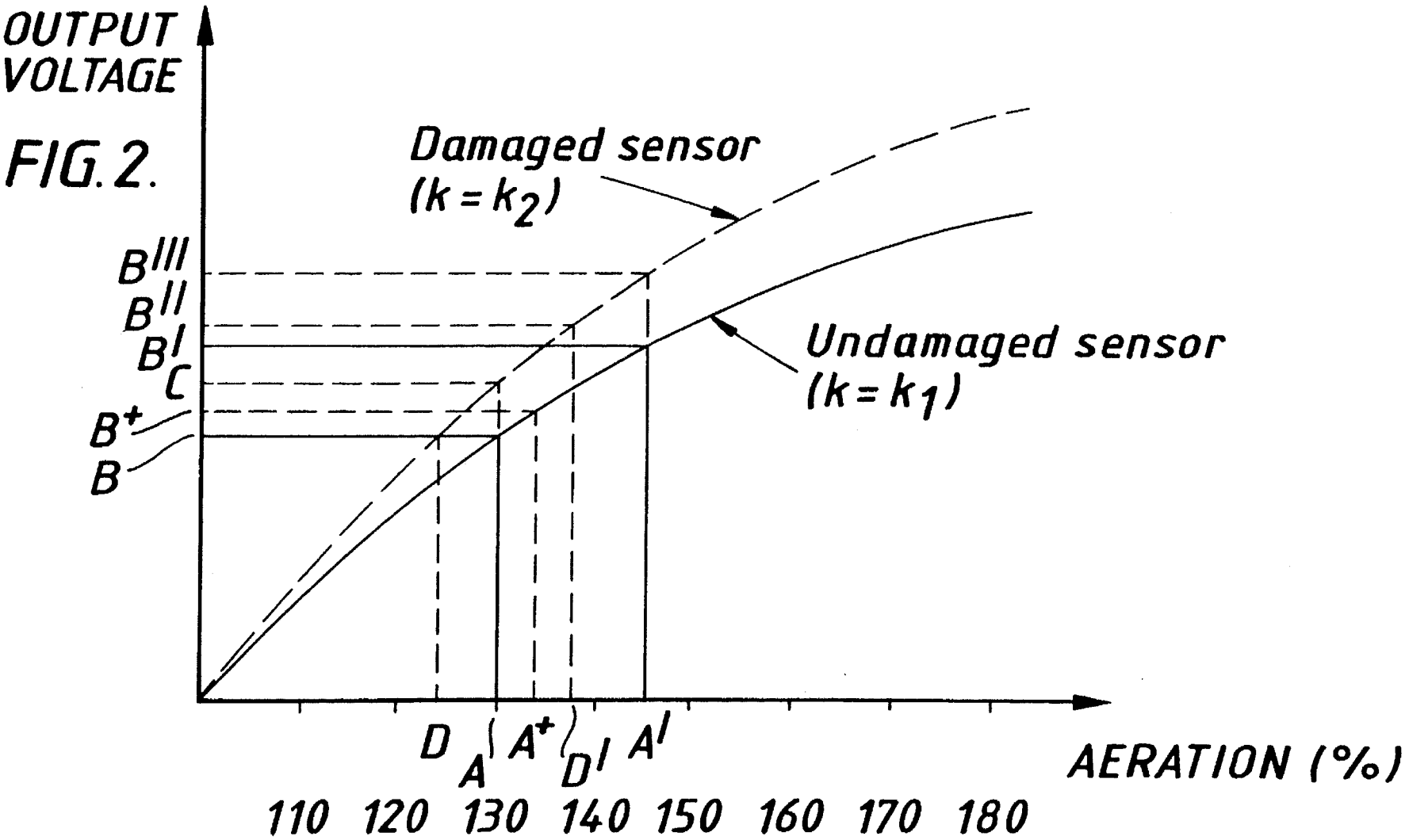

An embodiment of the invention will now be particularly described with reference to the drawings in which:

FIG. 1 is a schematic view of a domestic combustion system and control apparatus, FIG. 2 is a graph of the combustion sensor output signal (voltage) against aeration percentage for the same sensor in two different types of condition illustrating the effects on the output voltage of changes in aeration and in sensor performance characteristics, and FIGS. 3*a* and 3*b* are flow charts illustrating the procedure for checking the performance of the sensor and for in effect recalibrating it if desired, when necessary.

Referring to the drawings, and in particular FIG. 1, the domestic combustion system comprises a boiler 1 contained within a room-sealed casing 2 mounted on the inside of an outside wall 3 of a dwelling. The boiler 1 contains a so-called fully-premixed burner 4 mounted upon and sealed to an enclosure 5, the burner 4 being designed to fire downwardly into the uppermost part of the enclosure 5 which forms a combustion chamber.

The enclosure 5 terminates in a lowermost flue 6 which has a vertical part 7 immediately beneath the enclosure 5 and a horizontal part 8 connected to the vertical part 7 and extending with a clearance 9 through a hole in the wall 3. The clearance 9 is formed by the horizontal part of a flanged outlet 10. The horizontal part 8 of the flue has a circumferential flange 11 spaced from the outer surface 12 of the wall 3. The flange 11 forms with a flanged guard 13 in the wall surrounding the clearance 9 and the outer surface 14 of the horizontal flue part 8 an air intake of the so-called "balanced flue" variety.

The burner 4 has a plenum chamber 15 beneath which is located the burner plate 16. Upstream from the plenum chamber 15 is a mixing chamber 17 where the air and fuel gas meet and mix before combustion.

Air for the burner 4 is provided by a variable speed fan 18 connected to the mixing chamber 17. Fuel gas for the burner 4 is provided by gas supply pipe 19 which connects to the mixing chamber 17. The gas is supplied from a pressurised main as conventional but the gas flow rate is controlled by a modulating gas valve 20 located in the gas line and a shut-off gas valve 21. The modulating gas valve 20 has an opening area which is variable to provide variation in the flow rate of the gas.

Pipework 22 is provided to supply cold water to and remove heated water from the boiler 1, a portion 23 of the piping 22 being in serpentine form and located mainly within the enclosure 5 to enable the water to be heated by the combustion products, the part 23 having finning 24 to improve heat exchange between the combustion gases and the water. Water is pumped through the pipework parts 22, 23 and around a hot water and central heating system (not shown) by a water pump 25.

An oxygen detecting combustion sensor 26 is located in the vertical part 7 of the flue 6, the sensor 26 providing an output voltage signal, the magnitude of which is directly related to the oxygen concentration in the flue gas and therefore, to the air to gas ratio or aeration of the combustible air/gas mixture since air is admitted into the enclosure 5 only through the burner plate 16, as a constituent of the mixture produced in the chamber 17.

A hot water temperature sensor 27 is located on an external part of the pipe portion 23, a combined igniter and flame failure detector 28 is located immediately beneath the burner plate 16 and a differential pressure assembly 29 is located between the fan and the mixing chamber 17.

The combustion system is controlled by a microelectronic control box 30. This controls the fan 18 via a line 31, the gas modulating valve 20 via a line 32 and the gas shut-off valve 21 via a line 33.

The control box 30 receives the output voltage signal from the combustion sensor 26 via a line 34 for subsequent processing as will be described later. Three values of voltage are stored in ROM in the control box 30, corresponding to the output of a correctly-functioning combustion sensor 26 respectively when the aeration is at an intended value, when the aeration is at a higher value bearing a defined relationship to the intended value and when the sensor is exposed to an atmosphere of fresh air, all as will be described later.

The control box 30 also receives a voltage signal from the hot water sensor 27 via line 35. The control box 30 compares the magnitude of this voltage with a reference voltage which represents the maximum safe temperature which the hot water should be allowed to reach and if the measured temperature is too high the control box 30 sends a signal along each of the lines 32 and 33 to close the gas valves 20 and 21 and deactivate the burner 4 until the temperature measured by the sensor 27 is reduced to some suitable lower value by the cooling action of the water flowing through the pipe portion 23.

In addition the control box 30 receives a voltage signal from the combined igniter and flame failure detector 28 via line 36. Should the flame extinguish at any time during combustion, the absence of voltage on line 36 will cause the control box 30 firstly to send a signal along line 33 to close the shut-off valve 21 as a safety precaution, secondly to energise the ignition function of the combined device 28 via line 36, and thirdly to re-open the valve 21 via line 33, to attempt to relight the flame. If the flame fails to relight, the control box 30 will close the valve 21 by the line 33, and disallow further burner operation until the cause of the failure is identified and eliminated.

If, when operating at a predetermined speed during the process for bringing the burner into use, the fan 18 is successful in promoting at least a certain prescribed rate of airflow through the air intake, casing 2, assembly 29, combustion system, enclosure 5 and flue 6, a switch within the assembly 29 will be activated by the differential pressure across the assembly 29. As a result a signal will be transmitted along the line 37 to the control box 30, which will then allow the sequence for burner startup to proceed. If, however, the airflow is insufficient to activate the switch within the assembly 29 (for example, because of a partial blockage at some point in the flow path described), no signal will be transmitted along the line 37 to the control box 30 and the attempt at burner startup will be aborted, in the interest of safety.

As normal, the control box 30 receives signals via line 38 from other devices (not shown) such as a room thermostat, domestic hot water cylinder thermostat and a dual-channel timeswitch to effect control of the supply of heat from the burner 4. The line 39 conveys voltage to the control box 30 from safety switches mounted on, and monitoring the temperature of, critical items, such as plastic flue components. The burner 4 will be deactivated if the temperature of such components exceeds a preset value.

It will be appreciated that the system components so far described except the sensor 26 and the control box 30 are conventional "off-the-shelf" items.

If the combustion sensor 26 is undamaged it will produce an voltage $V_{02}$ denoted by $V^{\star}$ and shown as B on the voltage axis of FIG. 2, the magnitude of $V^{\star}$ being representative of the intended aeration (shown as A=130%). The value B may be stored as a reference voltage. Assuming the sensor 26 remains undamaged any increase in the air flow rate relative to the gas flow rate will cause the voltage signal from the sensor 26 to change, say to the value $B^{+}$, different from the reference value B and corresponding to the increased aeration $A^{+}$. The difference ($B^{+}$–B) will be detected by the control box 30 on comparison of the signals and used by the control box 30 to alter (in this instance, reduce) the speed of the fan 18 to return the sensor output voltage $V_{02}$ to the value B in FIG. 2. In this way the aeration will be returned to the intended value A from an undesired value $A^{+}$. It will be appreciated that converse corrective action would be taken to rectify a condition of underaeration. Securing corrective action of this kind is indeed the reason for including the combustion sensor 26 in the control scheme and such computer controlled aeration control is well known and will not be described further.

Should, however, the combustion sensor become faulty for any reason, the sensor output voltage will no longer be directly representative of the actual aeration. If the fault is due to seal damage, at a given aeration the output voltage will be higher than it would be in an undamaged sensor. Thus in FIG. 2 with the damaged sensor the output voltage will be C rather than the stored reference value of B at the aeration A (130%).

Consequently, even though the aeration is correct, there will be a difference signal (C–B) generated by the control box 30 since the measured and reference voltages deviate from each other. This will cause the control box 30 to reduce the fan speed to remove the apparent overaeration. As a result, the actual aeration will be held to the lower value D in FIG. 2, at which the output voltage $V_{02}$ of the faulty sensor matches the reference voltage B. If the sensor continues to deteriorate in a similar manner, the actual aeration will become progressively lower, perhaps eventually falling into the dangerous substoichiometric range.

In the application of the invention the state of the sensor is monitored by the control box 30 at regular intervals (for example, every 15 minutes) to determine whether it is faulty or not. The procedure is as follows:

With the control system functioning under settled conditions, the output voltage from the combustion sensor 26 will equal a value stored in the control box 30 as representing the intended aeration; for example in FIG. 2, B volts for an intended aeration of A%, with a correctly functioning sensor. When a sensor check test is to be performed, the control box 30 causes the rate of flow of gas to be reduced by a preset known small proportion, by reducing the open flow area in the valve 20, the speed of the fan remaining unchanged. The known percentage reduction in gas flow rate will cause the aeration to increase by a definable percentage.

After a reasonable settling time (e.g. 15 seconds) the new sensor output voltage $(V_{02})_W$ is measured and the gas valve 20 is re-opened to its previous setting to return the gas flow rate to its original value.

Referring to FIG. 2, if the sensor is undamaged B volts will indeed represent 130% aeration. If, for instance, the gas flow rate is reduced by 10%, the aeration will change from 130% to 144.5%. (A'% aeration in FIG. 2) and the output from the sensor will become B' volts. This value is stored in ROM in the control box 30, as a reference voltage $(V_{02})_W^{\star}$= B'.

The control box 30 compares the new measured sensor output voltage $(V_{02})_W$ with $(V_{02})_W$=B' volts to determine whether these voltages are equal within the limits of resolution of the measuring circuitry in the control box 30. If they are, the sensor is considered undamaged. However, if the sensor is damaged the output voltage B volts will represent an aeration other than 130% before the test, e.g. D (124%) in FIG. 2. In this case, if the gas flow rate is reduced by 10% when the test is performed, the aeration would then increase to 137.8% (D' in FIG. 2). Correspondingly, the sensor output voltage $(V_{02})_W$ would be at a value B" volts instead of the value B' volts provided by an undamaged sensor. On comparison of the value $(V_{02})_W$ with $(V_{02})_W^{\star}$, the control box 30 will infer that the sensor is damaged from the fact that B" will differ from B', provided that there is a non-linear relationship between the sensor output voltage and the aeration of the combustible mixture.

Once it has been established that the sensor is faulty the severity of the fault is determined. For this purpose, the output voltage $(V_{02})_{air}$ from the damaged sensor is measured in an atmosphere of fresh air, produced by running the fan 18 for a short preset time at full speed, the valve 21 being closed. Using a stored voltage $(V_{02})_{air}^{\star}$ equal to the output voltage from an undamaged sensor of the same type tested under the same conditions a factor K is then calculated, where $$K=\frac{(V_{02})_{air}}{(V_{02})_{air}}\ *$$

For an undamaged sensor, $K=K_1=1.00$ and for a damaged sensor $K=K_2$.

If the damage takes the form of seal leakage, $K_2$ will be greater than 1.00. On the other hand a partially blocked (or "blinded") sensor would yield $K_2$ less than 1.00. The calculated value of the factor K is stored in RAM in the control box 30.

If the output voltage of the sensor is linearly related to the concentration of oxygen at the site of the sensor, the factor K may be used as a multiplier by which the voltages $V^{\star}$ and $(V_{02})_W^{\star}$ stored in ROM may be adjusted in the following manner to allow for the alteration in sensor performance:

Adjusted Reference Voltage (ARV)=$V^{\star}\times K$ and

Adjusted Expected Test Voltage (AETV)=$(V_{02})_W^{\star}\times K$.

For example, in FIG. 2, for the damaged sensor ($K=K_2$):

$$ARV=V^{\star}\times K=B\times K_2=C$$

$$AETV=(V_{02})_W^{\star}\times K=B'\times K_2=B'''$$

The voltages ARV and AETV are stored in RAM in the control box 30, and used as the basis for management of the combustion system by the control box 30. While the sensor remains undamaged, since the factor K is then unity, the voltages ARV and AETV will respectively assume the values $V^{\star}$ and $(V_{02})_W^{\star}$.

As, and if, the sensor continues to deteriorate, further tests will reveal the additional deterioration and cause fresh values of the adjusted voltages C and B''' to be calculated similarly, using further values of K obtained as described. The fresh values of the adjusted voltages will then be stored in RAM in place of the previous values of these voltages.

However, should any calculated value of K fall outside a permissible range of values defined by a lowermost value $K_{min}$ and an uppermost value $K_{max}$ stored in ROM in the control box 30, further operation of the combustion system will be disallowed by the control box 30 until the faulty sensor has been renewed.

If, on checking, it is found that the sensor is faulty, but that the calculated value of K lies within a permissible range defined as abovementioned, as a less desirable alternative to the step of adjusting the reference voltage and the expected test voltage from the respective undamaged-sensor values $V^{\star}$ and $(V_{02})_W^{\star}$, the control box 30 may be arranged to allow control of the combustion system to continue on the basis of the stored voltages $V^{\star}$ and $(V_{02})_W^{\star}$. However it will be appreciated that the range of values of K permissible in this case may differ from the range which is permissible when the reference voltage and expected test voltage are adjusted by the control box 30 as described.

The flow sheet in FIG. 3 shows in sequence form all the steps for sensor fault detection previously described.

Firstly, the main program reads the command register sequentially at 50 to determine at 51 if a sensor check is demanded. If not, the main program follows other routines in the control box 30, such routines being no part of the present invention, and in due course returns to 50 and determines again at 51 if a sensor check is demanded. If a check is demanded the main program enters the sensor checking routine at A and the gas flow rate is reduced by 10%, step 52, and a timer is started at 53. The time elapsed from starting the timer t is read at 54, and a preset time tp1 is looked up at 55 in a look-up table in the control box 30, time tp1 being sufficiently long to ensure that conditions at the sensor have changed and stabilised at a new value. The value of tp1 might, for example, be 15 seconds.

At 56 tp1 is compared with t and if t<tp1 the routine returns to 54; otherwise the timer is stopped and reset at 57, the sensor output voltage $(V_{02})_W$ is measured at 58, and stored at 59. The previous full gas flow rate is then reinstated at 60. The value $(V_{02})_W$ is read at 61 and the value of the Adjusted Expected Test Voltage (AETV) is looked-up at 62 from a look-up table in the control box 30. As shown AETV=$K\times(V_{02})_W^{\star}$ where $(V_{02})_W^{\star}$ is the voltage output of an undamaged sensor and K is the adjustment factor as defined above.

If $(V_{02})_W$=AETV at 63 then the routine returns at B into the main program of the control box 30.

If, however, $(V_{02})_W$ does not equal AETV then the calibration of the sensor has drifted and further action is taken to estimate the severity of the drift.

Firstly, the gas valve is closed at 64 and the fan speed is set to a maximum at 65. A timer is started at 66 and the time t elapsed from starting the timer is read at 67. A preset time tp2 is looked up at 68 in a look-up table in the control box 30, time tp2 being sufficiently long to ensure that the system has been purged and the atmosphere at the sensor is substantially unpolluted air. The time tp2 might, for example, be 15 seconds.

At 69 tp2 is compared with t and if t<tp2 the routine returns to 67, otherwise the timer is stopped and reset at 70 and the sensor output voltage in air at full fan speed, $(V_{02})_{air}$ is measured at 71 and this value is stored at 72.

Next the routine reads the stored value of $(V_{02})_{air}$ at 73 and looks up at 74 from a look-up table in the control box 30 the output voltage, $(V_{02})_{air}^{\star}$, of an undamaged sensor of the same type tested under the same conditions, and calculates at 75 the factor K from the ratio $$K=\frac{(V_{02})_{air}}{(V_{02})_{air}}\ *$$

as explained previously.

The value K is then stored at 76 and is read at 77. A value $K_{max}$ is read at 78 from a look-up table in the control box 30, where Kmax is the highest value of K permissible without the sensor being deemed too inaccurate for further use.

K is compared with $K_{max}$ at 79 and if K exceeds $K_{max}$ then the routine returns at C into the main program of the control box 30, which then disallows further operation of the combustion system until the faulty sensor has been renewed. If K does not exceed $K_{max}$, K is read again at 80 and at 81 a value $K_{min}$ is read in a look-up table in the control box 30, where $K_{min}$ is the lowest value of K permissible without the sensor being considered too inaccurate for further use.

K is compared with $K_{min}$ at 82 and if K is less than $K_{min}$ then the routine returns at C into the main program of the control box 30.

If K is not less than $K_{min}$ then the routine reads the program command register at 83 to find at 84 if adjustment is desired to the voltages ARV and AETV. This step in the routine establishes whether the option of correcting the stored voltages ARV and AETV is to be taken up. If there is to be no adjustment of the stored voltages ARV and AETV to compensate for sensor damage, the routine returns to B. Otherwise K is read again at 85, the stored value of $V^{\star}$ is looked up at 86, the adjusted reference voltage (ARV) is calculated from K and $V^{\star}$ ($K \times V^{\star}$) at 87 and the new ARV is stored at 88.

Next K is read again at 89, $(V_{02})_W^{\star}$ is looked up at 90, the adjusted expected test voltage (AETV) is calculated from $K \times (V_{02})_W^{\star}$ at 91 and the new AETV is stored at 92. Then the routine returns at B into the main program, which then follows other routines forming no part of the present invention before eventually returning to A.

Although the foregoing has described means for sensor fault detection based on imposing a known percentage reduction in the rate of gas flow without altering the fanspeed, it will be appreciated that the same results may be achieved by imposing a known percentage increase in the fanspeed while keeping the rate of gas flow unaltered. Furthermore it will be apparent to one skilled in the art that, less desirably, equivalent results may be obtained in the converse manner, by imposing a known percentage increase in the rate of gas flow without altering the fanspeed, or alternatively by imposing a known percentage decrease in the fanspeed while keeping the rate of gas flow unaltered.

Again, while the invention is principally concerned with gas fired combustion systems of the fan-assisted, fully-premixed type, it will be appreciated that the fault detection techniques described may be applied to any combustion system in which the rate of supply of fuel or oxidant may be adjusted, provided that the output signal of the sensor is non-linearly related to the variable being controlled. Furthermore, the fault compensation technique described may be applied to any system in which there is a linear relationship between the output signal of the sensor and the variable being sensed.

I claim:

1. Apparatus for compensating for faults in a sensor providing an output signal representative of the aeration of a combustible mixture, the apparatus comprising means for checking whether a current value of a stored reference signal with which the output signal is compared to control the aeration is suitable for causing an intended value of aeration to be maintained, means for estimating a corrected value of the stored reference signal in the event that a current value of the stored reference signal is found on checking not to be suitable for causing an intended value of aeration to be maintained and means for storing the corrected value of the reference signal with which the output signal is then compared.

2. Apparatus as claimed in claim 1 in which the means for checking whether a current value of the stored reference signal comprises means for altering temporarily the relative rate of flow of air and fuel by a predetermined percentage, means for measuring the output signal of the sensor while the altered conditions obtain, means for calculating an expected value of the sensor output signal in the altered circumstance and means for comparing the measured and expected values of the sensor output signal to determine whether they differ by more than a prechosen amount and that therefore correction of the stored reference signal may be necessary.

3. Apparatus as claimed in claim 2 in which the means for temporarily altering the relative rate of flow of air and fuel controls the rate of supply of air.

4. Apparatus as claimed in claim 2 in which the means for temporarily altering the relative rate of flow of air and fuel controls the rate supply of fuel.

5. Apparatus as claimed in claim 2 in which the means for temporarily altering the relative rate of flow of air and fuel is adapted to operate at regular preset intervals during combustion.

6. Apparatus as claimed in claim 1 or claim 2 in which the means for estimating the corrected value of the stored reference signal comprises means for measuring the output signal when the sensor is not exposed to products of combustion, means for comparing the measured output signal of the sensor with a stored output signal equal to the output signal which would be provided by a perfectly functioning sensor of the same type in the same circumstances, means for calculating a factor based on the measured and stored output signals and means for using the factor to estimate the corrected value of the reference signal from the current value of the stored reference signal.

7. Apparatus as claimed in claim 1 in which means is provided for closing a gas valve to terminate combustion, should the value of the stared reference signal be shown by checking to be no longer suitable for causing the intended value of the aeration to be maintained within predetermined limits.

* * * * *